US005609443A

United States Patent [19]

Shimomura

[11] Patent Number: 5,609,443

[45] Date of Patent: Mar. 11, 1997

[54] METHOD FOR DRILLING DIFFICULT MACHINABLE MATERIALS

[75] Inventor: Taizo Shimomura, Kawasaki, Japan

[73] Assignee: Kabushiki Kaisha Shimomura Seisakusho, Kanagawa-ken, Japan

[21] Appl. No.: 597,861

[22] Filed: Feb. 7, 1996

Related U.S. Application Data

[62] Division of Ser. No. 335,326, Nov. 7, 1994, Pat. No. 5,531,548.

[51] Int. Cl.[6] ..... B23B 35/00

[52] U.S. Cl. ..... 408/1 R; 408/145; 408/230

[58] Field of Search ..... 408/1 R, 8, 10, 408/11, 17, 56, 61, 130, 145, 230

[56] References Cited

U.S. PATENT DOCUMENTS

| | | | |
|---|---|---|---|
| 1,309,706 | 7/1919 | Taylor | 408/230 |
| 4,198,180 | 4/1980 | Schultz | 408/10 |
| 4,688,970 | 8/1987 | Eckman | 408/10 |
| 4,745,557 | 5/1988 | Pekar et al. | 408/10 |
| 5,022,798 | 6/1991 | Eckman | 408/1 R |
| 5,531,548 | 7/1996 | Shimomura | 408/145 |

*Primary Examiner*—Daniel W. Howell
*Attorney, Agent, or Firm*—Bauer & Schaffer

[57] ABSTRACT

A drill to cut hardly machinable materials has major flanks extending in a backward direction of rotation from major cutting edges with an ascending slope and ultra-hard cutting grains adhered to said major flanks, at least. When the rotating drill contacts the work-piece, the ultra-hard cutting grains adhered to the most backward part of the major flanks to the direction of rotation cut the work-piece at first. As the ultra-hard cutting grains of the major flanks drop off by the cutting, actual cutting parts move to adjacent part forward of the rotation of the major flanks. Finally, major cutting edges take over the cutting of the work-piece.

2 Claims, 4 Drawing Sheets

METHOD FOR DRILLING DIFFICULT MACHINABLE MATERIALS

This is a divisional of Ser. No. 08/335,326, filed Nov. 7, 1994 now U.S. Pat. No. 5,531,548.

FIELD OF THE INVENTION

The present invention relates to a drill for materials that are hard to drill, such as inorganics, e.g., ceramics and the like, and drilling method using the same.

BACKGROUND OF THE INVENTION

As shown in FIG. 3, cutting portion of a drill D1 comprises, in general, a chisel edge 26, a major cutting edge 1 extending linearly outwards from a chisel edge corner 26*a*, a major flank 2 extending in a backward direction of drill rotation from the major cutting edge 1, and a rake face 3 extending from the major cutting edge 1 in the shape of a grooved surface.

Conventionally, for the drilling of inorganic substances such as ceramics and other materials that are hard to cut (hereinafter referred simply to "work-piece"), a carbide drills having ultra-hard alloys as cutting edge material, a drill electroplated with ultra-hard cutting grains S, such as diamond, to the major cutting edge 1, or the like (hereinafter referred simply to "drill"), were used.

In such conventional drill D1, the major flank 2 was formed as descending slope in a backward direction of drill D1 rotation from the major cutting edge 1. When drill the work-piece, the chisel edge 26 comes into contact with the work-piece at first, then the major cutting edge 1 begins to cut the work-piece and continues thereafter with the major cutting edge 1 only.

As a result, the major cutting edge 1 tended to fatigue and the drill must be exchanged often during the drilling. In particular, in case of a drill electroplated with the ultra-hard cutting grains S to its major cutting edge 1, the ultra-hard cutting grains S tended to drop off due to its linear configuration. Also adhering the ultra-hard cutting grains S to the major cutting edge 1 was very difficult.

In the meantime, during the drilling operation, a rotating drill is pressed against the work-piece with a fixed pressure until drilling is completed supplying a coolant for lubrication and cooling. Inevitably, the rotation of the drill was braked due to friction between the drill and the work-piece. Then, the drilling operation required long time and the work-piece was sometimes damaged or broken.

The continuous contact of the rotating drill with the work-piece made it difficult to penetrate the coolant into the drilled hole. Consequently, the cutting portion of the drill and the work-piece are not adequately cooled but are heated to a high temperature. It caused decreasing of durability of the drill and deterioration and damage of the work-piece.

SUMMARY OF THE INVENTION

It is an object of the invention to provide a drill superior in its durability.

An other object of the invention is to provide an efficient drilling method using such drill without damaging the drill and the work-piece.

To attain such objects, the drill according to the invention has major flanks extending in a backward direction of rotation from the major cutting edge with an ascending slope in a backward direction of the rotation and ultra-hard cutting grains adhered to said major flanks, at least. Preferably, major cutting edge is adhered also with the ultra-hard cutting grains in addition to the major flank.

Further, in the invention for the drilling method, the work-piece is cut using the drill according to the invention and varying contact pressure between the drill and the work-piece. In such drilling method, it is preferable to include a process to separate the drill and the work-piece during the drilling process together with supplying a coolant between the drill and the work-piece.

According to the invention of the drill, a portion of the ultra-hard cutting grains adhered to most backward part of the major flank to the rotation direction cuts the work-piece at first. When such ultra-hard cutting grains on the major flank has dropped off by continued cutting operation, actual cutting part of the major flank moves forward to the rotating direction. This is due to the shape of the major flank ascending from the major cutting edge in the backward direction of the rotation. The work-piece is finally cut by the major cutting edge.

As stated above, since the actual work cutting part of the cutting portion of the drill moves forward along the rotating direction on the major flank and finally reaches to the major cutting edge, its durability is superior to the conventional drill by which only the cutting edge is used.

In addition, unlike the conventional drill in which ultra-hard cutting grains are adhered on a linear major cutting edge, the ultra-hard cutting grains are adhered on a surface (major flank) of the drill according to the invention. Therefore, the adhered grains are hard to drop off.

Further, adhering of the ultra-hard cutting grains on a surface (major flank) is easier than adhering the ultra-hard cutting grains to the linear major cutting edge.

According to the invention for the drilling method, the work-piece is cut with varying contact pressure between the drill and the work-piece. In particular, the drilling is performed varying the pressure to the work-piece between high and low values. If the contact pressure of the drill to the work-piece is high, rotation rate decreases due to higher resistance to the rotation. However, as the contact pressure is lowered afterwards, the rotation of the drill recovers to a normal rate. Thus, since the drilling operation proceeds recovering the rotation rate of the drill, efficiency of the drilling is high. The drill and the work-piece will not be damaged because there is no excessive load to the drill or the work-piece.

In said invention for the drilling method, when a procedure to separate the drill and the work-piece is inserted during the cutting process supplying the coolant between the drill and the work-piece, the coolant can easily penetrate into a hole formed in the work-piece. Therefore, the drill and the work-piece will not be damaged because the overheat of the drill and the work-piece can be avoided.

Further in the invention for the drilling method, either is possible that the work-piece is fixed and the drill is mounted to make possible to approach or separate, or, inversely, that the drill is fixed and the work-piece is mounted to make possible to approach or separate.

DETAILED DESCRIPTION OF THE INVENTION

An example of an apparatus according to the invention is described with reference to the drawings.

Figure 1:
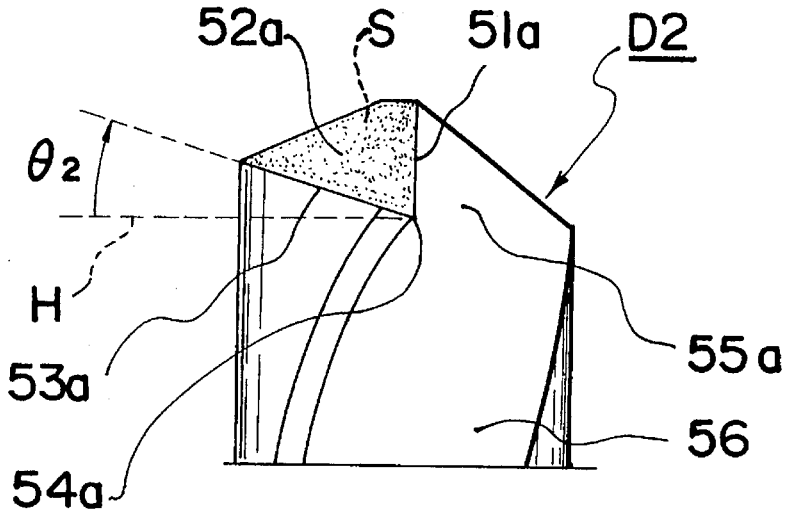
FIG. 1 is a front view of the drill D2 according to one embodiment of this invention.
Figure 2:
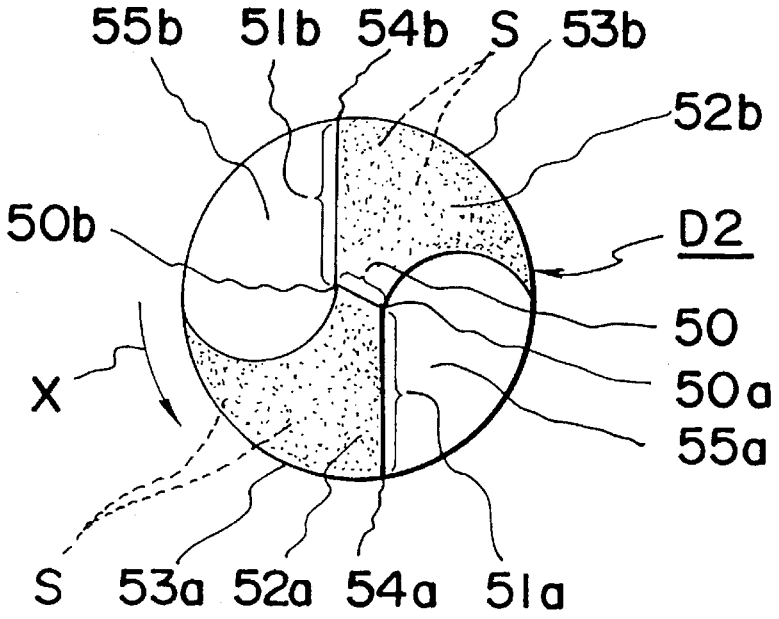
FIG. 2 is a plan view of the drill D2 shown in FIG. 1.

As shown in FIGS. 1 and 2, the drill D2 according to the invention has a chisel edge 50 on the top. The major cutting edges 51*a* and 51*b* extend linearly outwards from corners 50*a* and 50*b* of the chisel edge 50. As shown in FIG. 1, these major cutting edges 51*a* and 51*b* slope downwards to outer corners 54*a* and 54*b*.

On the forward side of the major cutting edges 51*a* and 51*b* to rotating direction of the drill D2 (indicated by an arrow X in FIG. 2), rake faces 55*a* and 55*b* are formed in the shape of grooved surfaces connected with the major cutting edges 51*a* and 51*b*. Such rake faces 55*a* and 55*b* are connected with chips ejecting flutes 56 which are grooved spirally on the body of the drill D2.

Major flanks 52*a* and 52*b* extend in a backward direction of the drill D1 rotation from the major cutting edge 51*a* and 51*b*. These major flanks 52*a* and 52*b* extend in the shape of a fan from the chisel edge 50 viewed from the top of the drill D2.

Figure 3:
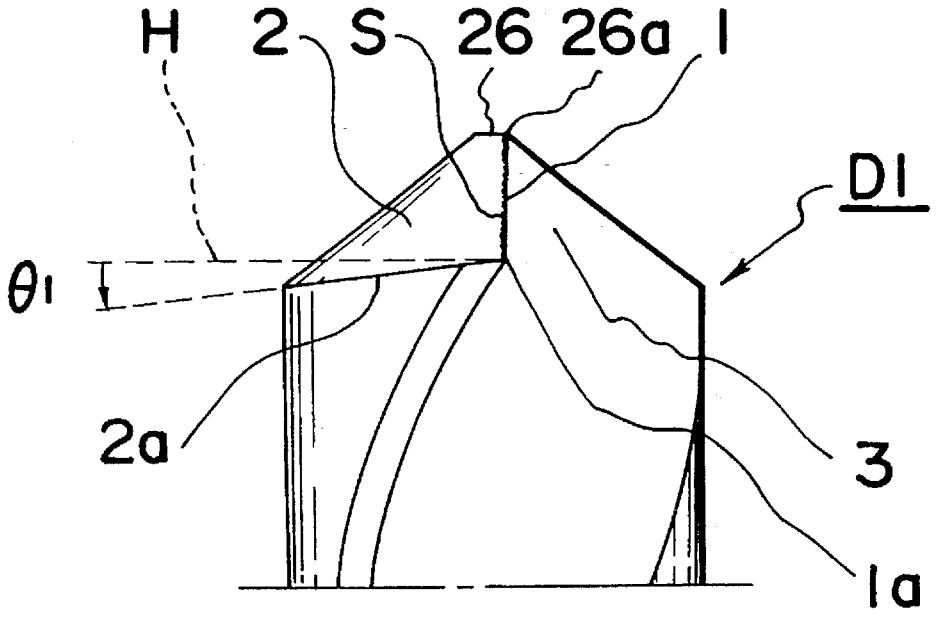
FIG. 3 PRIOR ART
FIG. 3 is a front view of a conventional drill D1.

As described above, in the conventional drill D1 shown in FIG. 3, the major flanks 2 were descending forward from the major cutting edge 1 in a backward direction of the drill D1 rotation. That is, when the drill D1 placed its edge upwards was viewed from its front as shown in FIG. 3, outer edge 2*a* of the major flank 2 sloped downwards against a horizontal reference line H passing the outer corner 1*a*. Its downward slope θ1 was set at 10 to 15 degree.

On the contrary, in the drill D2 according to the present invention, the major flanks 52*a* and 52*b* are ascending forward from the major cutting edge 51*a* and 51*b* in a backward direction of the drill D2 rotation. Then, when the drill D1 placed its edge upwards is viewed from its front as shown in FIG. 1, outer edge 2*a* of the major flank 2 slopes upwards against a horizontal reference line H passing the outer corners 54*a* and 54*b*. Its upward slope θ2 may be 10 to 15 degree or more. For marginal design, such upward slope can be 0 degree.

In the drill D2 according to this embodiment, ultra-hard cutting grains S are adhered on surfaces of said major cutting edges 51*a* and 51*b* and said major flanks 52*a* and 52*b*. As the ultra-hard cutting grains S, diamond is used typically. The ultra-hard cutting grains S are adhered by conventional methods such as electroplating. In particular, for example, metal, such as nickel, is plated on a drill body, then the ultra-hard cutting grains S are included in said plating layer, such as nickel.

When a carbide drill is used as the drill D2, adhering of the ultra-hard cutting grains S to the major cutting edges 51*a* and 51*b* is not always necessary.

When drilling in the work-piece using the drill D2 constructed as above, chisel edge 50 of the rotating drill D2 contacts the work-piece at first. Then, a part of the ultra-hard cutting grains S which are adhered on the major flanks 52*a* and 52*b* backwards to the rotating direction of drill D2 cuts the work-piece. As such part of the ultra-hard cutting grains S which has cut the work-piece drop off after continued drilling, the part of the major flanks 52*a* and 52*b* which cut actually the work-piece moves forwards to the rotating direction of the drill D2. This is because the major flanks 52*a* and 52*b* are formed with ascending slope from the major cutting edges 51*a* and 51*b* in a backward direction of the rotation. Finally, the major cutting edges 51*a* and 51*b* cut the work-piece.

As described above, according to the drill D2, not only the major cutting edges 51*a* and 51*b*, but also the major flanks 52*a* and 52*b* which did not participate in the cutting work in the prior art, participate in the cutting work. Furthermore, when a part of the ultra-hard cutting grains S which participate in the cutting work actually, have been dropped off, the adjacent part of the ultra-hard cutting grains S which are on the major flanks 52*a* and 52*b* in a forward direction of the drill D2 rotation takes over the cutting. Therefore, the drill according to the invention is superior in durability compared with the conventional drill D1 which uses the major cutting edge 1 only.

Further, unlike the conventional drill D1 in which the ultra-hard cutting grains S are adhered on a linear cutting edge 1, the adhered grains on the drill according to the present invention are hard to drop off because the ultra-hard cutting grains S are adhered on surfaces (major flanks 52*a* and 52*b*).

Further, adhering the ultra-hard cutting grains S on surfaces (major flanks 52*a* and 52*b*) is easier than adhering the ultra-hard cutting grains S on a linear part of the major cutting edge 1.

Figure 4:
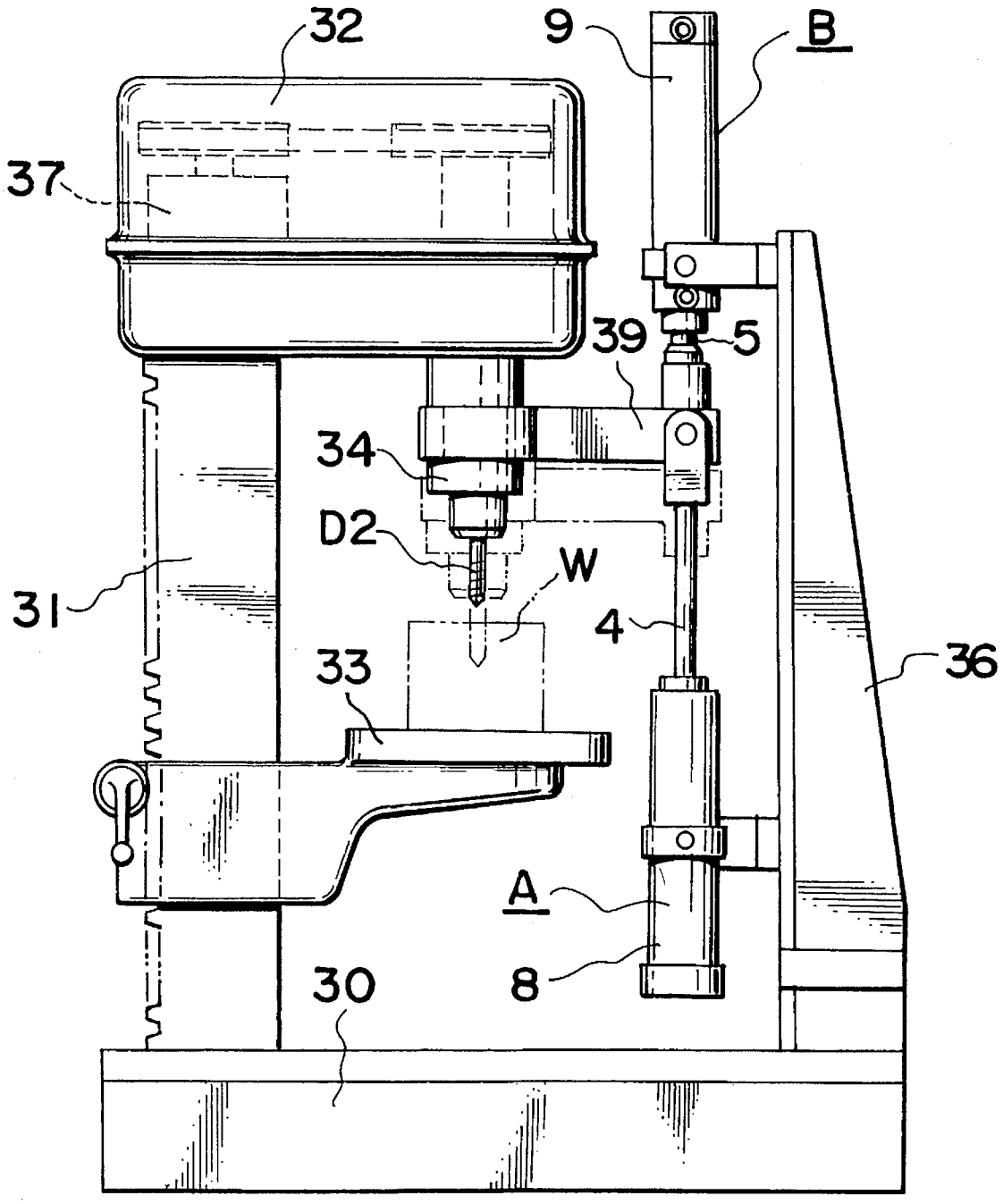
FIG. 4 is a front view showing an example of an apparatus for drilling a work-piece.
Figure 5:
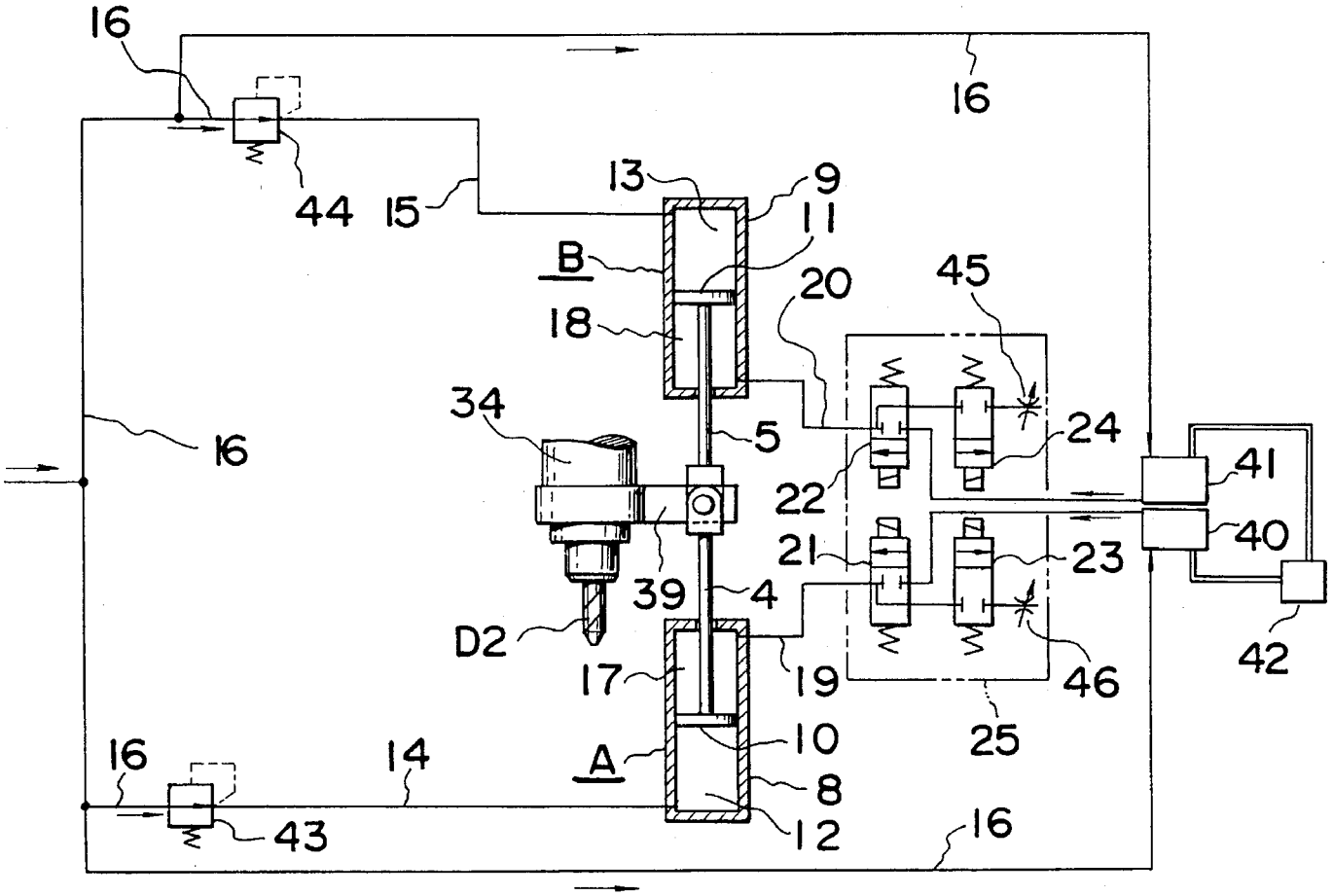
FIG. 5 is a diagrammatic view of a control circuit for use with the apparatus shown in FIG. 4.

Following is the description of the drilling method according to the present invention with reference to FIGS. 4 and 5.

FIG. 4 shows an example of a drilling machine to practice the method according to the invention. In FIG. 4, 30 is a base, 31 is a column, 32 is a spindle head, 33 is a table. A spindle 34 stretches out downwards from the spindle head 32. The spindle 34 is supported by the spindle head 32 enabling up and down movement. A drill according to the invention D2 is mounted downwards at the bottom end of the spindle 34.

Air cylinders A and B are provided parallel to the spindle 34 and the drill D2. Piston rods 4 and 5 of the air cylinders A and B are connected coaxially in opposite direction. Tubes 8 and 9 of the air cylinders A and B are supported by a supporting column 36 on the base 30. 37 in FIG. 4 is a motor to rotate the spindle 34, W is a work-piece fixed on the table 33.

The piston rods 4 and 5 and the spindle 34 are linked with a horizontal connecting member 39. The word "link" means a relation with which the up and down movement of the spindle 34 by the piston rods 4 and 5 is possible without hindering rotation of the spindle 34.

In particular, one end of the connecting member 39 is fixed to the side of the piston rods 4 and 5. The other end of the connecting member 39 is set free to the rotation of the spindle 34 and makes possible only the up and down movement of the spindle 34. In this way, during the drilling operation, cylinder A and B moves the spindle 34 and the drill D2 upwards or downwards, and motor 37 rotates them simultaneously.

Control of the up and down movement of the spindle 34 and the drill D2 by the air cylinders A and B is as follows: As shown in FIG. 5, the air cylinders A and B comprises the piston rods 4 and 5, tubes 8 and 9, and pistons 10 and 11.

A switching valve 25 is provided on pipelines 19 and 20 from the rod cover side compartments 17 and 18 in the tubes 8 and 9. The switching valve 25 connects or disconnects the relation between the pipelines 19 and 20 and an operating pressure line 16. Air in the rod cover side compartments 17 and 18 is vented at such disconnection.

The switching valve 25 comprises valves 21, 22, 23 and 24, each having two ports. The switching valve 25 is constructed previously so that the valves 21 and 24 may be simultaneously operated to be opened or closed and valves 22 and 23 may be simultaneously operated to be opened or closed. The operating pressure line 16 is connected to the valve 21 through a servo-valve 40, and to the valve 22 through the servo-valve 41. The servo-valves 40 and 41 control the amount of compressed air supplied from the operating pressure line 16 to the rod cover side compartments 17 and 18 through the valves 21 and 22. In FIG. 6, 42 shows a control apparatus of the servo-valves 40 and 41.

On pipelines 14 and 15 from the head cover side compartments 12 and 13 in the tube 8 and 9, pressure reducing relief valves 43 and 44 are provided respectively. The pipelines 14 and 15 are connected to the operating pressure line 16 to keep the pressures in the rod cover side compartments 12 and 13.

That is, when either of the pressure in the head cover side compartments 12 or 13 becomes negative due to displacement of the pistons 10 and 11, the pressure reducing relief valves 43 or 44 supply compressed air from the operating pressure line 16 to a negative pressure compartment 12 (or 13) to restore the specified pressure. Simultaneously, it restores the specified pressure in the positive pressure compartment 13 (or 12) by venting air in it. In this way, the pressure reducing relief valves 43 and 44 act to keep constant pressures in the head cover side compartments 12 and 13.

With such construction, the spindle 34 and the drill D2 can be lowered through connecting member 39, operating switching valve 25 so that air under a fixed operating pressure is fed from the operating pressure line 16 to the rod cover side compartment 17 of the cylinder A, and that air in the rod cover side compartment 18 of the air cylinder B is discharged. With a reverse action of the switching valve 25, the spindle 34 and the drill D2 can be elevated through the connecting member 39.

Lowering of the spindle 34 and the drill D2 is controlled as follows: When the spindle 34 and the drill D2 is to be lowered, both the valves 22 and 23 are closed and both the valves 21 and 24 are opened, simultaneously.

When the valve 21 is opened, compressed air from the operating pressure line 16 is fed to the rod cover side compartment 17 through the servo-valve 40 and the pipeline 19. At the same time, the valve 24 is opened, then air in the rod cover side compartment 18 is discharged through the pipeline 20 and the throttle valve 45. In this way, the pistons 10 and 11 are lowered and the spindle 34 and the drill D2 are lowered.

On the other hand, the pressures in the head cover side compartments 12 and 13 of the air cylinders A and B are kept constant by the action of the pressure reducing relief valves 43 and 44, in spite of displacements of the pistons 10 and 11. In such way, lowering movement of the spindle 34 and the drill D2 is not disturbed.

In addition, as the pressures in the head cover side compartments 12 and 13 are kept constant in spite of displacement of the pistons 10 and 11, the pistons 10 and 11 can be stopped at specified positions completely. Then, the work-piece W can be drilled by the drill D2 with a specified contact strength.

Elevating of the spindle 34 and the drill D2 is controlled as follows: When the spindle 34 and the drill D2 is to be elevated, both the valves 21 and 24 are closed and both the valves 22 and 23 are opened, simultaneously.

When the valve 22 is opened, compressed air from the operating pressure line 16 is fed to the rod cover side compartment 18 through the servo-valve 41 and the pipeline 20. At the same time, the valve 23 is opened, then air in the rod cover side compartment 17 is discharged through the pipeline 19 and the throttle valve 46. In this way, the pistons 10 and 11 are elevated and the spindle 34 and the drill D2 are elevated.

On the other hand, the pressures in the head cover side compartments 12 and 13 of the air cylinders A and B are kept constant by the action of the pressure reducing relief valves 43 and 44, in spite of displacements of the pistons 10 and 11. In such way, elevating movement of the spindle 34 and the drill D2 is not disturbed.

As described above, controlling automatically the air supply to either of the rod cover side compartment 17 or 18 by switching valve 25, approaching and separating action of the drill D2 relative to the work-piece is controlled. Further, by controlling properly the amount of air supplied to the rod cover side compartments 17 and 18 with servo-valves 41 and 42, the contact pressure of the drill D2 against the work-piece W can be varied.

The above explanation is an example of an apparatus according to the invention with which the work-piece W is fixed and the drill D2 is controlled to approach or separate relative to the work-piece W. Inversely, an apparatus according to the invention is possible with which the drill D2 is fixed and the work-piece W is controlled to approach or separate relative to the drill D2.

The invention may be embodied in other specific forms without departing from the spirit or essential characteristics thereof. Above described examples show some instances and shall not be deemed to restrict the present invention. The scope of the invention is indicated by the appended claims and the specification does not restrict it. Further, all equivalents or modifications which are in the scope of the claims are included in the present invention.

I claim:

1. Method of drilling difficult machinable materials comprising the steps of providing a drill having major flanks extending in a backward direction of rotation from the major cutting edges, an ascending slope and ultra-hard cutting grains adhered to said major flanks, engaging said drill and work-piece and varying the contact pressure between said drill and the work-piece.

2. Method of drilling difficult machinable materials comprising the steps of providing a drill having major flanks extending in a backward direction of rotation from the major cutting edges, an ascending slope and ultra-hard cutting grains adhered to said major flanks, engaging said drill with a work-piece, supplying cutting fluid between the drill and the work-piece, varying contact pressure between said drill and the work-piece, and separating said drill and the work-piece during the cutting.

* * * * *